US008453341B2

(12) United States Patent
Elsasser

(10) Patent No.: US 8,453,341 B2
(45) Date of Patent: Jun. 4, 2013

(54) DEVICE FOR MEASURING AND CUTTING ROOFING SHINGLES

(76) Inventor: Henry John Elsasser, Woodburn, OR (US)

( * ) Notice: Subject to any disclaimer, the term of this patent is extended or adjusted under 35 U.S.C. 154(b) by 173 days.

(21) Appl. No.: 13/078,977

(22) Filed: Apr. 3, 2011

(65) Prior Publication Data

US 2012/0247062 A1 Oct. 4, 2012

(51) Int. Cl.
*G01B 3/04* (2006.01)
*G01B 3/14* (2006.01)

(52) U.S. Cl.
USPC ..... 33/562; 33/566; 83/821

(58) Field of Classification Search
USPC ..... 33/429, 474, 476, 482, 562, 563, 33/566; 83/821
See application file for complete search history.

(56) References Cited

U.S. PATENT DOCUMENTS

| | | | | | |
|---|---|---|---|---|---|
| 727,680 | A * | 5/1903 | Otis | 33/476 |
| 2,642,674 | A * | 6/1953 | Schell, Jr. | 33/527 |
| 3,104,467 | A * | 9/1963 | Lloyd-Young | 33/476 |
| 3,376,650 | A * | 4/1968 | Cook | 33/566 |
| 3,797,122 | A * | 3/1974 | Smith | 33/562 |
| 3,834,033 | A * | 9/1974 | Pinkard | 33/563 |
| 4,010,592 | A * | 3/1977 | Nixon | 52/748.1 |
| 4,128,030 | A * | 12/1978 | Kundikoff | 83/745 |
| 4,584,775 | A * | 4/1986 | Boman | 83/821 |
| 4,584,780 | A * | 4/1986 | Pressey | 33/563 |
| 4,651,434 | A * | 3/1987 | Haynes | 33/481 |
| 4,776,250 | A * | 10/1988 | Julius | 83/745 |
| 4,924,594 | A * | 5/1990 | Fernandes | 33/483 |
| 5,392,677 | A * | 2/1995 | Sevart et al. | 83/468.3 |
| 5,456,015 | A * | 10/1995 | Butcher et al. | 33/451 |
| 5,644,963 | A * | 7/1997 | Fountas | 83/454 |
| 6,122,891 | A * | 9/2000 | Carpenter | 52/748.1 |
| 6,289,594 | B1 * | 9/2001 | Wrobbel | 33/42 |
| 6,851,201 | B1 * | 2/2005 | Gioia et al. | 33/479 |
| 6,868,616 | B2 * | 3/2005 | Allemand | 33/476 |
| 7,472,492 | B1 * | 1/2009 | Vecchio | 33/562 |

* cited by examiner

*Primary Examiner* — Christopher Fulton
(74) *Attorney, Agent, or Firm* — Jason S. Marin, Esq.

(57) ABSTRACT

This invention relates to a portable and easy to use device for measuring and cutting a starter course set for shingling a roof.

5 Claims, 6 Drawing Sheets

FIG. 5a
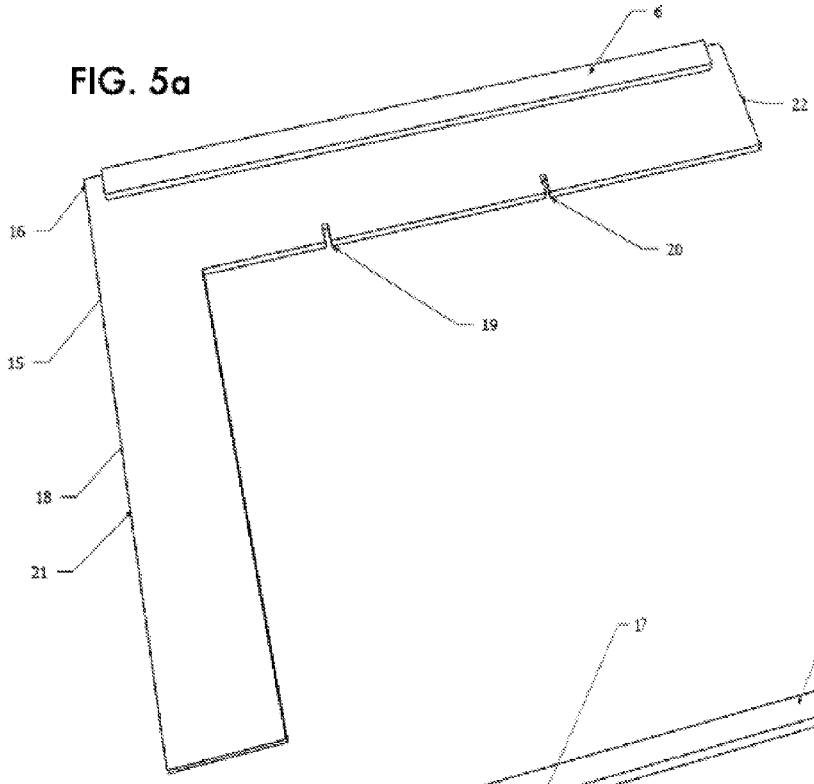
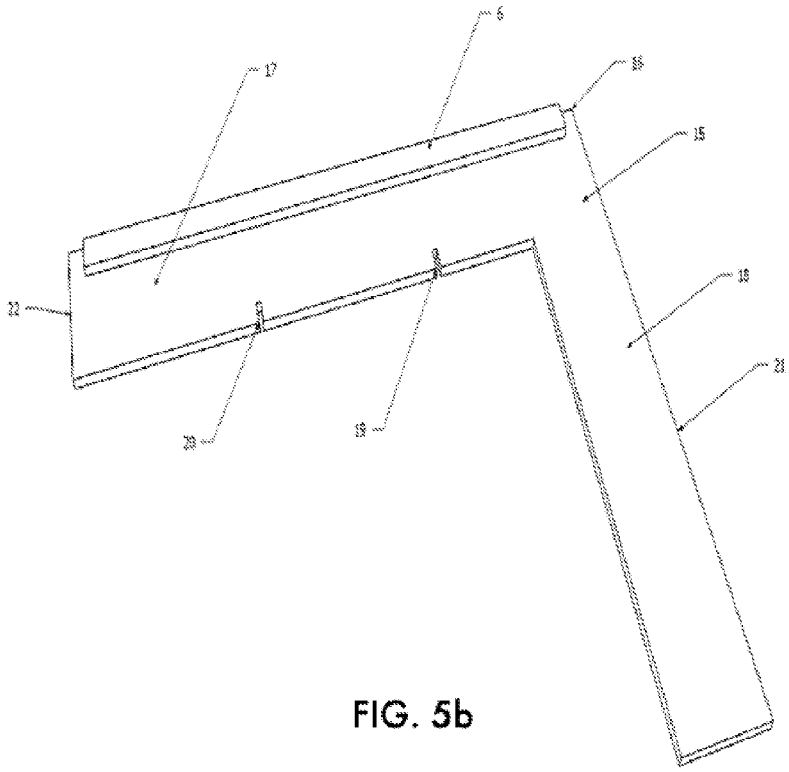
FIG. 5b

FIG. 6a
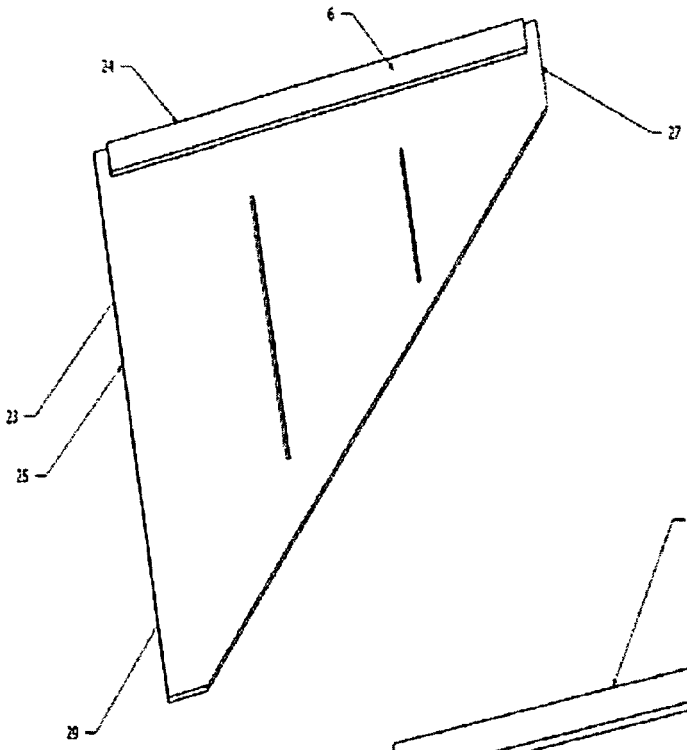
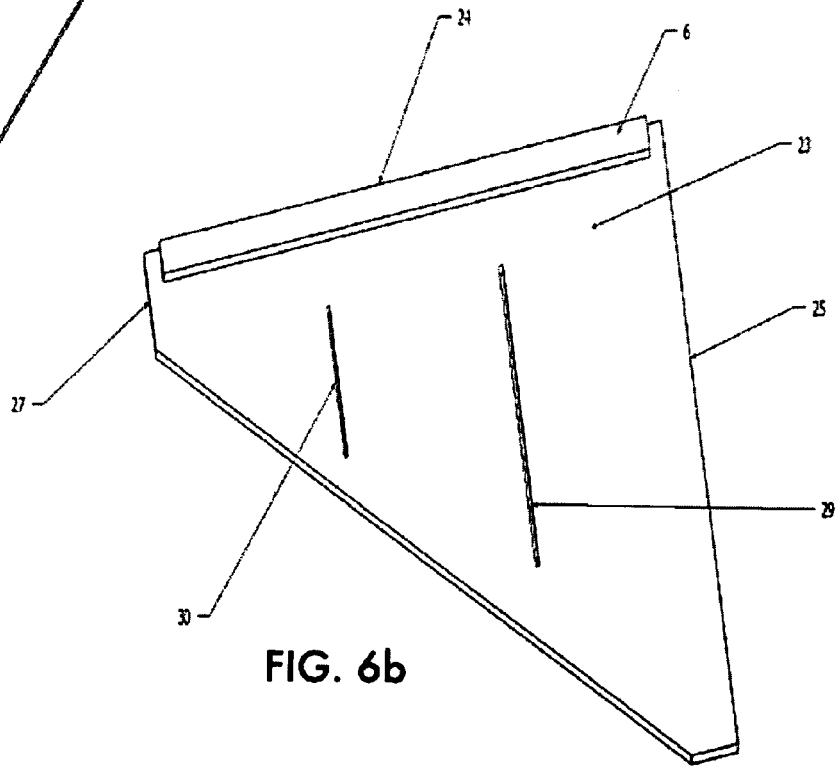
FIG. 6b

DEVICE FOR MEASURING AND CUTTING ROOFING SHINGLES

BACKGROUND OF THE INVENTION

This present invention relates to the field of roofing. More particularly, the present invention relates to an apparatus for precisely measuring and cutting architectural style roofing shingles, so that the resulting roofing job is both attractive and creates minimal waste. Composition shingles are in demand for roofing projects because their use reduces both material costs and labor costs, as single shingles can be used to cover greater areas, and require less time to cover a roof.

Composition shingles reduce labor and material costs because a single unit contains more than one shingle. For both aesthetic and practical reasons (relating to the runoff of rain water) the shingles must be staggered to create parallel unbroken lines when used along the straight edge of a gabled roof. The staggering must be done such that the shingle slot of a given shingle does not match up with the slot of the immediately adjacent shingles.

When shingling a roof, a "starter step course" is used for the first portion of the roof. It has been the practice of roofers to lay down the first row of shingles utilizing a full three shingle unit and then staggering each unit from this particular shingle The standard factory recommended dimension in roofing systems for cutting the these starter step shingles is 5⅝". Currently, there are a number of different ways people in the field attempt to achieve the 5⅝" setback. Some individuals will use a tape measure to get the 3 cuts and a framing square for cutting. Others will set a shingle in place then mark the far edge and then cut from their mark. Still others will place a mark on their nail gun and then freehand cut the shingle without a square. In all of these methods, there remains a portion of the shingle that is "scrap" which must either be thrown out or which must be carried to the other side of the roof for use. With the present invention the "scrap" end of each shingle is usable for the steps. Further, the present invention provides for superior precision in cutting the shingles because of its specific shape and features. The present invention can be used for cutting the right hand ends of shingles when finishing the rows. Another use is to create ¾" overhang at gabel ends by using the stop at the outside end of a roof.

In light of the above prior art and difficulties, it is the object of the present invention to provide a template for a person engaging in a roofing project to quickly, accurately and easily precut shingle units to the desired size with the portions normally treated as "scrap" remaining usable without any additional effort by the roofer.

In addition, due to the size, shape and construction of the present invention, a second device could be used as a cutting board to be placed under the shingles while using the first device to measure the cuts to be made.

SUMMARY OF INVENTION

The present invention is a roofing tool comprising a flat surface with cutting marks or slots at specific positions and a lip enabling easy, efficient and precise cutting of composition shingles. In a particular embodiment of the invention, the body of the device is a rectangle with two cutting slots. In another embodiment of the invention, the body of the device is shaped like an L with two notches in place of the cutting slots. In yet another embodiment, in the body of the device an angle is cut across bottom instead of a basic rectangular shape, for purposes of cutting valleys. In all embodiments, the notches or slots on the main body are placed at specific distances from each other and from the sides of the device.

BRIEF DESCRIPTION OF THE DRAWINGS

FIG. 3*b* is an alternate view of the L shaped embodiment of the device

FIG. 5*a* is a 2½" embodiment of the device

FIG. 5*b* is an alternate view of the 2½" embodiment of the device

FIG. 6*a* is an angle bottom embodiment of the device.

FIG. 6*b* is an alternate view of the angle bottom embodiment of the device

DETAILED DESCRIPTION

Figure 1:
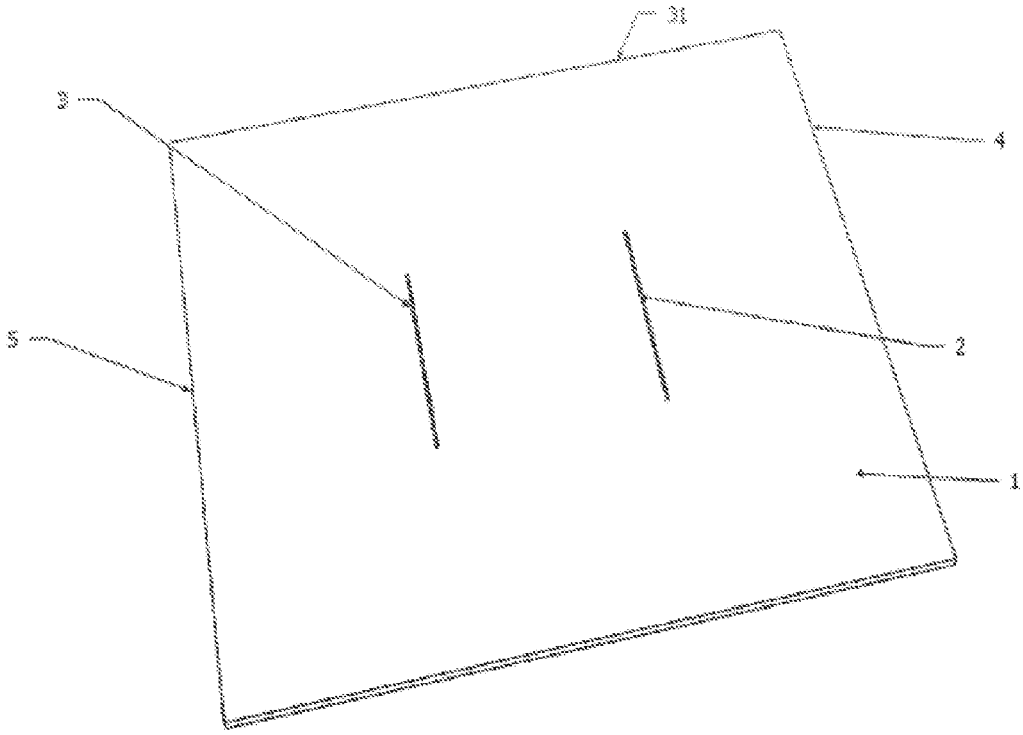
FIG. 1 is a top side view of the preferred embodiment of the device.

Referring now to the invention in more detail, in FIG. 1 the device is a simple structure preferably fabricated from molded plastic, but which could also be made from wood, metal or other hard substance. The device comprises a flat rectangular body 1 measuring 14½" high by 16⅞" wide, upon the middle of which there are two slots, 2 and 3. Slots 2 and 3 are of equal size, and slot 2 is 5⅝" from the side edge 4 and 5⅝" from slot 3. Slot 3 is also 5⅝" from side edge 5.

Figure 2:
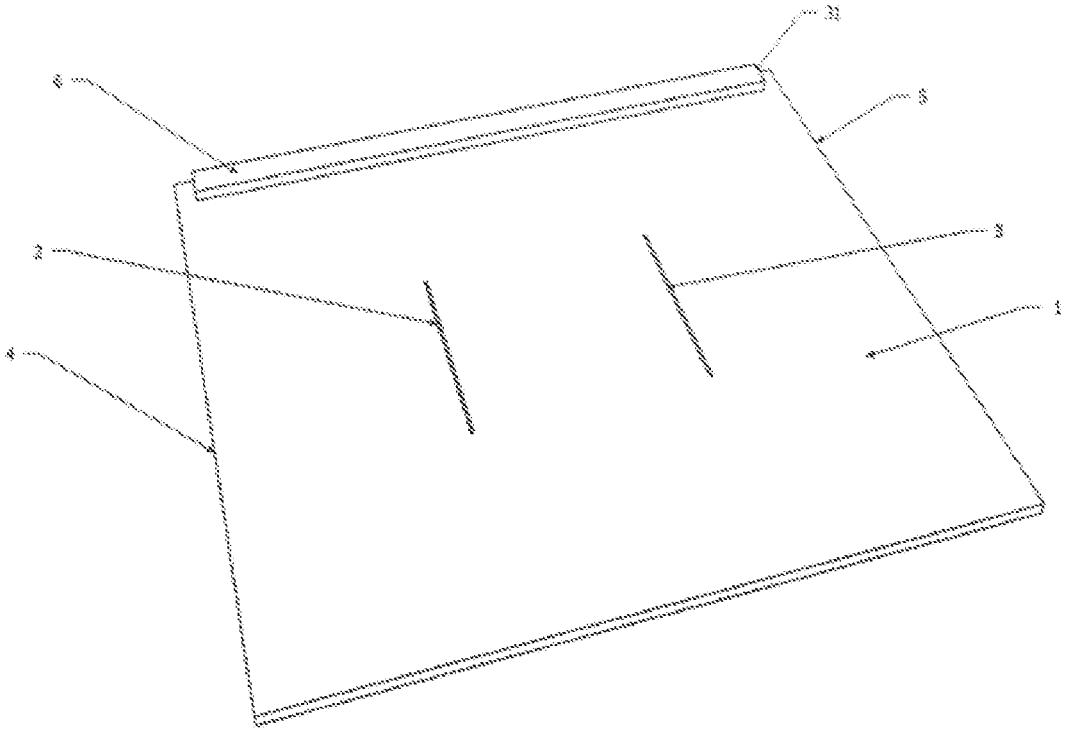
FIG. 2 is an under side view of the preferred embodiment of the device.
Figure 3A:
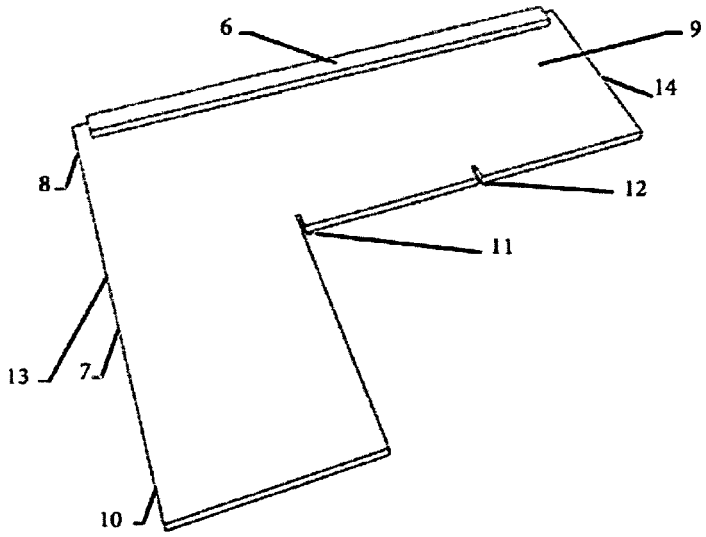
FIG. 3*a* is an L shaped embodiment of the device

In FIG. 2 the same elements of the device can be seen with the device turned over. Specifically Body 1, slots 2 and 3, side edges 4 and 5 and lip 6 can be seen from the bottom. Body 1 also contains a lip 6 on the underside of the top edge 31 of the body that allows the device to not slip off of the composition shingles to be cut using the device In FIG. 3*a*, another embodiment of the device is shown where Body 7 is shaped like an L measuring 14½" high along Side Arm 10 by 16⅞" wide along Top Arm 9. Side Arm 9 and Side Arm 10 are joined at corner 8.

Top Arm 9 is 6⅜" tall, and Side Arm 10 is 5⅝" wide. Measuring Notch 11 is on Top Arm 9 exactly 5⅝" from Edge 13. Measuring Notch 12 is 5⅝" from Edge 14, and 5⅝" from Measuring Notch 11. This embodiment is shown upside down so that Lip 6 on the bottom of Top Arm 9 can be seen. FIG. 3*b* shows a variation of this embodiment where a second lip 6' is on the underside of Body 7 in the same position on Top Arm 9 that lip 6 is on the front side of Body 7.

Figure 3A:
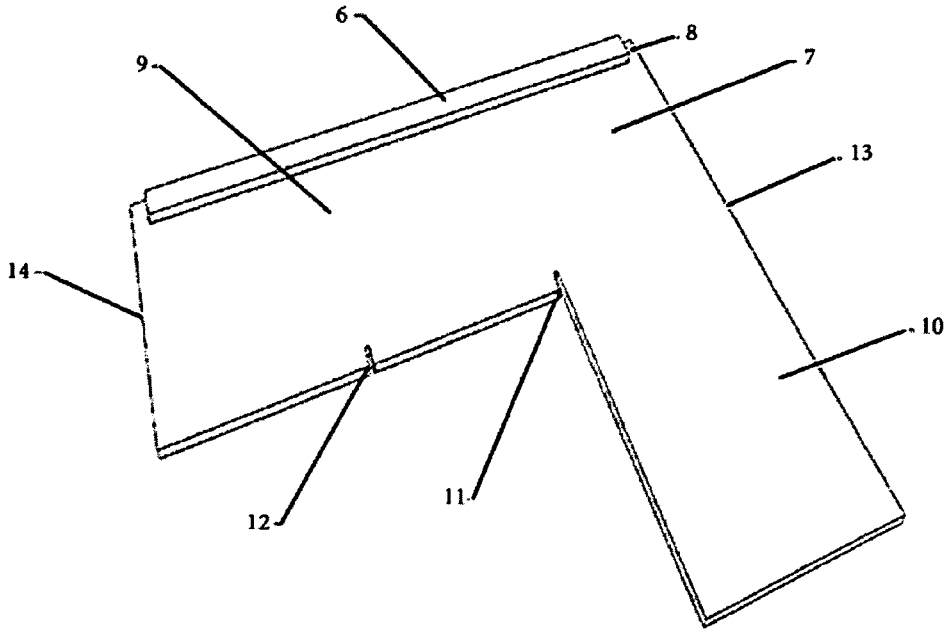
Figure 4:
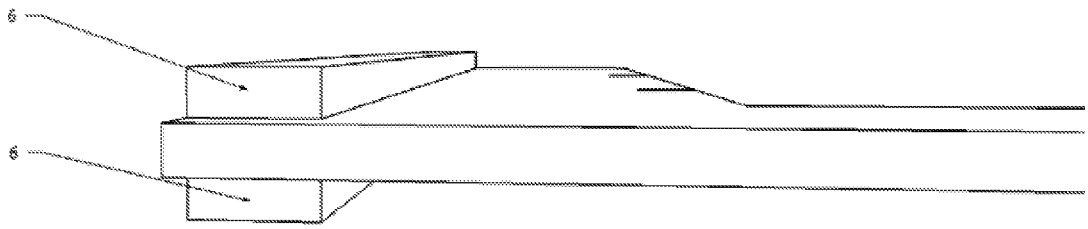
FIG. 4 is a side view of the L shape embodiment showing a variant element.

In FIG. 4, a variant element for all embodiments is shown, in which in addition to lip 6 on one side of the top edge of the body (shown in connection with Top Arm 9 of Body 17 of FIG. 3), a second lip 6' is on the reverse side of the body in the identical position. This allows for ease of use by both left and right handed individuals.

In FIG. 5*a*, another embodiment of the device is shown which is a variant of the L shaped device of FIG. 3. Body 15 is shaped like an L, with Top Arm 17 measuring 16⅞" wide and 3¼" high and Side Arm 18 measuring 14½" tall and 2½" wide. Top Arm 17 and Side Arm 18 are joined only at the top corner 16. Top Arm 17 is 3¼" high and Side arm 18 is 2½" wide. Measuring notch 19 is on top arm 17 exactly 5⅝" from Edge 21. Measuring notch 20 is 5⅝" from Edge 22, and 5⅝" from Measuring notch 19. This embodiment is shown upside down so that Lip 6 on the bottom of Top Arm 17 can be seen. FIG. 5*b* shows a variation of this embodiment where a second Lip 6' is on the underside of Body 15 in the same position on Top Arm 17 that Lip 6 is on the front side of Body 15.

In FIG. 6*a*, another embodiment of the device is shown in which Body 23 has top edge 24 that measures 16⅞" wide, side edge 25 that measures 14½", and opposite side edge 27 that measures 2¼" from top edge 24, and bottom edge 26 that measures 1½" from side edge 25. Slot 29 is exactly 5⅝" from Edge 25. Measuring notch 30 is 5⅝" from Edge 27, and 5⅝" from Measuring notch 29. This embodiment is shown upside down so that Lip 6 on the bottom of Top Edge 24 can be seen. FIG. 6*b* shows a variation of this embodiment where a Second Lip 6' is on the underside of Body 13 in the same position on Top Edge 24 that Lip 6 is on the front side of Body 15. The advantages of the present invention include, without limitation the reduction of wasted materials and time and enhancement of efficiency while preparing shingles through provision of superior guidelines. All of these advantages enable a superior final roofing product when the invention is used.

While the foregoing written description of the invention enables one of ordinary skill to make and use what is considered presently to be the best mode thereof, those of ordinary skill will understand and appreciate the existence of variations, combinations, and equivalents of the specific embodiment, method and examples herein. The invention should not be limited by the above described embodiment, method and examples, but by all embodiments and methods within the scope and spirit of the invention.

I claim:

1. A device for use as a roofing tool comprising: a body with at least a top edge measuring 16⅞ inches wide and a right edge measuring 14½ inches high; an opening in the body 5⅝ inches from the far right edge of the body; a second opening in the body 5⅝ inches from the first opening and 5⅝ inches from the far left edge of the body; and a lip between 3/16 inches and ¼ inch high on the bottom of the top edge of the device, 13¾ inches from the bottom edge of the device.

2. A device as set forth in claim 1 wherein the body is constructed from a hard material such as wood, metal or molded plastic.

3. A device as set forth in claim 1 wherein the openings in the body are slots measuring at least 5 inches high and no more than ⅛ inches wide.

4. A device as set forth in claim 3 wherein there is a second lip of the same size and shape as the first lip on the top of the top edge of the body, at the exact same position that the first lip appears on the bottom of the top edge.

5. A device as set forth in claim 1 wherein there is a second lip of the same size and shape as the first lip on the top of the top edge of the body, at the exact same position that the first lip appears on the bottom of the top edge.

* * * * *